US006201510B1

(12) United States Patent
Lopez et al.

(10) Patent No.: US 6,201,510 B1
(45) Date of Patent: Mar. 13, 2001

(54) SELF-CONTAINED PROGRESSIVE-PHASE GPS ELEMENTS AND ANTENNAS

(75) Inventors: Alfred R. Lopez, Commack; Richard J. Kumpfbeck, Huntington; Edward M. Newman, Nesconset, all of NY (US)

(73) Assignee: BAE Systems Advanced Systems, Greenlawn, NY (US)

( * ) Notice: Subject to any disclaimer, the term of this patent is extended or adjusted under 35 U.S.C. 154(b) by 0 days.

(21) Appl. No.: 09/358,615

(22) Filed: Jul. 21, 1999

(51) Int. Cl.[7] ..... H01Q 21/20

(52) U.S. Cl. ..... 343/799; 343/797; 343/798; 343/803; 343/810; 343/814; 343/891

(58) Field of Search ..... 343/793, 795, 343/798, 799, 800, 802, 810, 811, 812, 813, 814, 890, 891, 853, 796, 797, 803, 806

(56) References Cited

U.S. PATENT DOCUMENTS

| | | | | |
|---|---|---|---|---|
| 2,688,081 | * | 8/1954 | Laport | 343/779 |
| 3,375,524 | * | 3/1968 | Kunemund et al. | 343/779 |
| 3,887,925 | * | 6/1975 | Ranghelli et al. | 343/795 |
| 4,038,662 | * | 7/1977 | Turner | 343/752 |
| 4,193,077 | * | 3/1980 | Greenberg et al. | 343/747 |
| 4,446,465 | * | 5/1984 | Donovan | 343/797 |
| 5,534,882 | | 7/1996 | Lopez | 343/891 |
| 5,936,590 | * | 8/1999 | Funder | 343/795 |

* cited by examiner

*Primary Examiner*—Tho Phan
(74) *Attorney, Agent, or Firm*—Edward A. Onders; Kenneth P. Robinson

(57) ABSTRACT

A self-contained four-dipole element provides a 360 degree phase-progressive-omnidirectional (PPO) circularly polarized antenna pattern. Via a single signal port, a PPO excitation network incorporated into the element excites the four dipoles at phases differing by successive 90 degree increments. The four-dipole element is adapted for efficiently reproducible fabrication using printed circuit techniques. Antennas employing a stack of the elements provide a hemispherical antenna pattern with PPO circular polarization and a sharp cutoff below horizontal. For GPS reception in Differential GPS aircraft landing applications, a 21 element antenna provides multipath suppression and a unitary phase center enabling avoidance of signal phase discrepancies. More or fewer elements may be employed in other applications.

15 Claims, 5 Drawing Sheets

SELF-CONTAINED PROGRESSIVE-PHASE GPS ELEMENTS AND ANTENNAS

RELATED APPLICATIONS (Not Applicable)

FEDERALLY SPONSORED RESEARCH (Not Applicable)

BACKGROUND OF THE INVENTION

This invention relates to antennas to receive signals from Global Positioning System (GPS) satellites and, more generally, to self-contained progressive-phase-omnidirectional elements and antennas utilizing a linear vertical array of such elements.

Antenna systems providing a circular polarization characteristic in all directions horizontally and upward from the horizon, with a sharp cut-off characteristic below the horizon are described in U.S. Pat. No. 5,534,882, issued to A. R. Lopez on Jul. 9, 1996. Antennas having such characteristics are particularly suited to reception of signals from GPS satellites.

As described in that patent, application of the GPS for aircraft precision approach and landing guidance is subject to various local and other errors limiting accuracy. Proposed implementation of Differential GPS (DGPS) would provide local corrections to improve accuracy at one or more airports in a localized geographical area. A DGPS ground installation would provide corrections for errors, such as ionospheric, tropospheric and satellite clock and ephemeris errors, effective for local use. The ground station would use one or more GPS reception antennas having suitable antenna pattern characteristics. Of particular significance is the desirability of antennas having the characteristic of a unitary phase center of accurately determined position, to permit precision determinations of phase of received signals and avoid introduction of phase discrepancies. Antenna systems having the desired characteristics are described and illustrated in U.S. Pat. No. 5,534,882, which is hereby incorporated herein by reference.

Objects of the present invention are to provide new and improved elements and antennas, and elements and antennas having one or more of the following characteristics and advantages:

- progressive-phase-omnidirectional elements;
- self-contained elements providing a progressive-phase-omnidirectional pattern via a single signal port;
- simplified progressive-phase excitation network includable within a self-contained antenna element;
- self-contained four-dipole elements usable in stacked configurations;
- antennas using a stack of identical individually-excited progressive-phase-omnidirectional elements;
- antennas including a stack of such elements with excitation of different amplitude or phase, or both; and
- antennas utilizing a stack of such elements, including directly excited and indirectly excited elements.

SUMMARY OF THE INVENTION

In accordance with the invention, a four-dipole element, double tuned for reception at two GPS frequencies, incorporates a progressive-phase-omnidirectional excitation network. The element includes a signal port and first, second, third and fourth dipoles successively spaced around a vertical axis and each having two opposed arms. The progressive-phase-omnidirectional (PPO) excitation network is coupled between the signal port and the four dipoles and includes (a) a first quadrature coupler coupled between the first and second dipoles to provide first dipole excitation of a first phase and to provide second dipole excitation of a quadrature phase, (b) a second quadrature coupler coupled between the third and fourth dipoles to provide third dipole excitation of a phase differing by 180 degrees from the first phase and to provide fourth dipole excitation of a quadrature phase differing by 180 degrees from the second dipole excitation, and (c) first and second transmission line sections respectively coupled between the signal port and the first and second quadrature couplers; and four resonant circuits, one coupled to each dipole to provide double tuning for signal reception at two GPS frequencies.

In the context of each dipole of the above-described four-dipole element having a left arm and a right arm when viewed from the vertical axis, the element may be configured so that: the first quadrature coupler has a port coupled to the left arm of the first dipole and a quadrature port coupled to the left arm of the second dipole; and the second quadrature coupler has a port coupled to the right arm of the third dipole and a quadrature port coupled to the right arm of the fourth dipole.

Also in accordance with the invention, a GPS antenna with progressive-phase-omnidirectional excitation includes a four-dipole first element incorporating a PPO excitation network having first and second quadrature couplers as described above, and a plurality of four-dipole additional elements each substantially the same as the first element. The additional elements include upper elements positioned above and lower elements positioned below the first element along the vertical axis. The antenna also includes a signal distribution network coupled between an antenna output port and the signal ports of the first element and a plurality of the additional elements. Typically, the signal distribution network is arranged to provide excitation signals to the upper elements which lags excitation signals provided to the first (middle) element by a 90 degree phase differential, and excitation signals to the lower elements which leads excitation signals provided to the first (middle) element by a 90 degree phase differential. As a result, PPO excitation of the upper elements and lower elements will respectively lag and lead the PPO excitation of the first (middle) element by a 90 degree phase differential.

For a better understanding of the invention, together with other and further objects, reference is made to the accompanying drawings and the scope of the invention will be pointed out in the accompanying claims.

DESCRIPTION OF THE INVENTION

Figure 1:
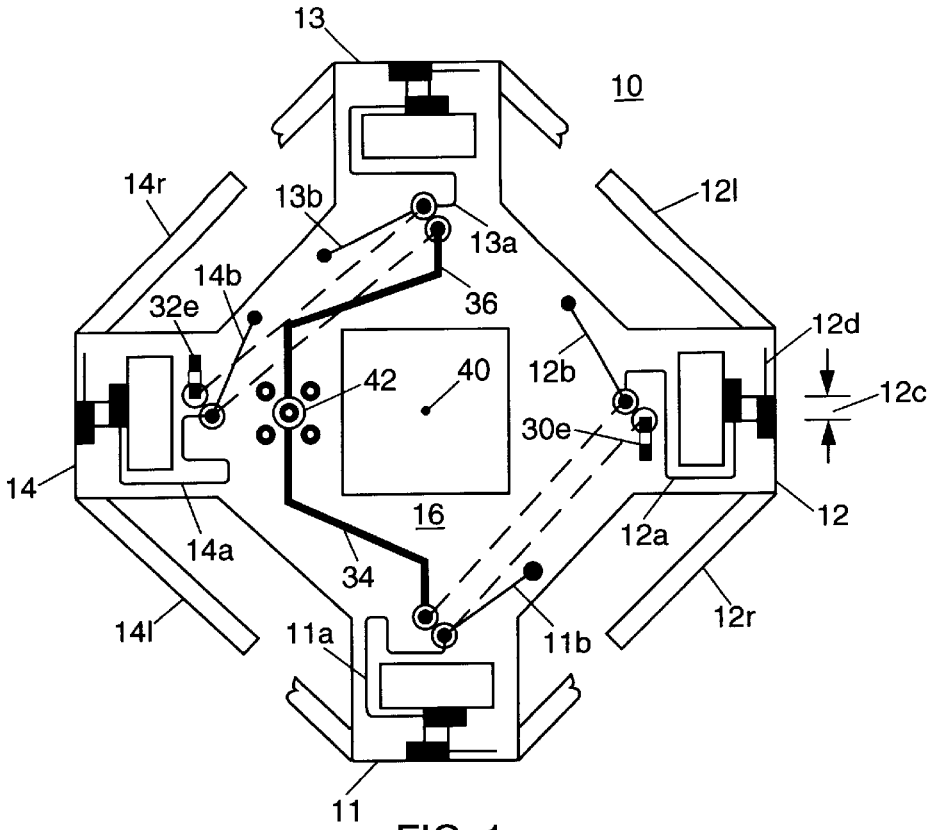
FIG. 1 is a top view of a four-dipole element pursuant to the invention (two dipoles are shown with partial arms for clarity of presentation).

FIG. 1 shows a four-dipole element 10 in accordance with the invention. Element 10 includes first, second, third and fourth dipoles 11, 12, 13, 14, respectively. Each dipole includes two opposed arms. The ends of the arms of dipoles 11 and 13, which would overlap arms of adjacent dipoles in this view, have been partially removed for clarity of illustration. In actual use, all four dipoles are of substantially identical construction.

Figure 2:
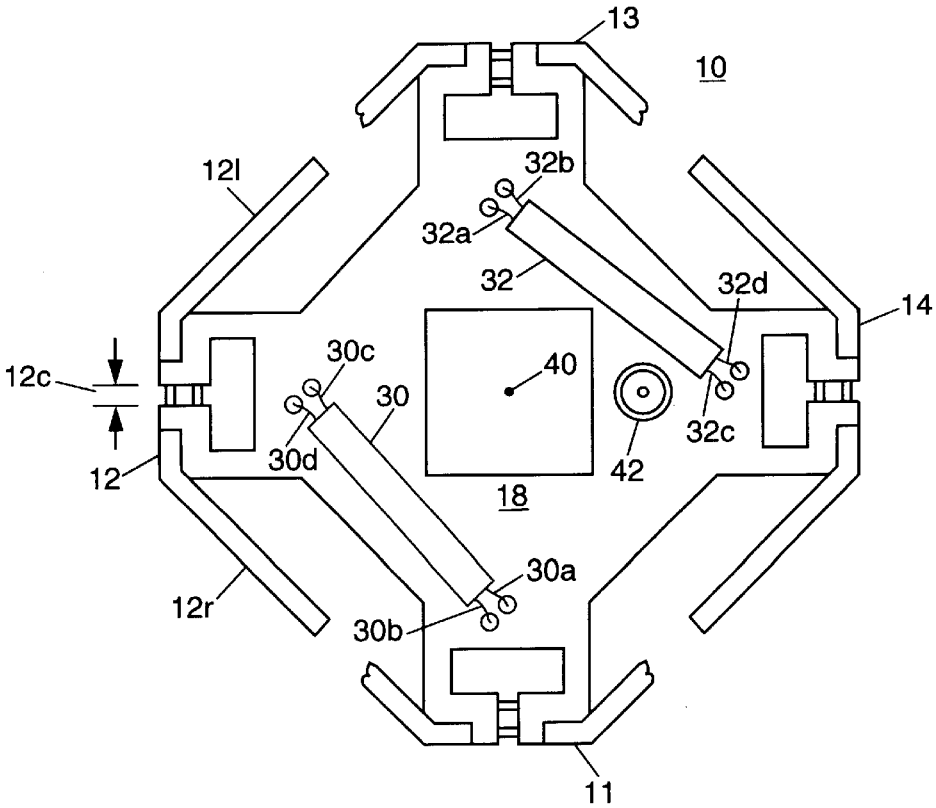
FIG. 2 is a bottom view of the FIG. 1 element.

FIG. 1 illustrates an implementation using printed circuit techniques. In FIG. 1, conductor configurations are supported on the top surface of an insulative layer or substrate 16. The bottom view of FIG. 2, shows the bottom surface of a conductive (e.g., copper) layer 18 adhered to substrate 16. In this embodiment, individual arms of the dipoles (e.g., arms 12*l* and 12*r* of second dipole 12) are separately fabricated and soldered or otherwise attached at appropriate positions to the conductive layer 18. At particular locations, circuit connections pass through openings in conductive layer 18 and substrate 16 to circuit portions above. At other locations circuit connections pass through substrate 16 from above to make conductive contact with layer 18, which represents ground potential. Element 10 includes a square central cutout suitable to receive a square mast and other cutouts to be described.

Figure 3:
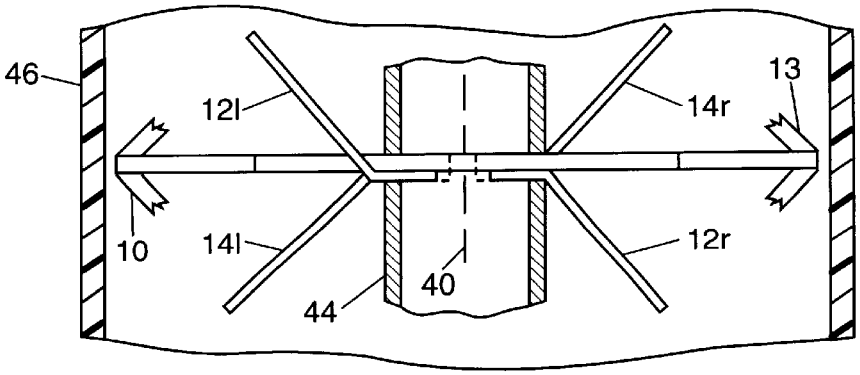
FIG. 3 is a side view of the FIG. 1 element.

As shown in the FIG. 3 side view of the FIG. 1 four-dipole element, opposed arms 12*l* and 12*r* of dipole 12 extend respectively upward and downward at approximately 45 degrees diagonally to horizontal. Arms 14*i* and 14*r* of dipole 14, at the back of element 10 in the view of FIG. 3, are also visible. The four dipoles 11, 12, 13, 14 of element 10 are successively spaced around a vertical axis 40, shown dashed in FIG. 3 and in end view in FIGS. 1 and 2. Dipole arms are labeled l and r, representing the left arm and right arm when viewed from vertical axis 40 (i.e., viewed from a position above the top surface of element 10, looking outward from axis 40).

Four-dipole element 10 includes a signal port illustrated as coaxial connector 42. Connector 42 is shown with its outer conductor portion mounted to conductive layer 18 and its center conductor passing through layer 18 to the upper surface of substrate 16.

Element 10 also includes a progressive-phase-omnidirectional (PPO) excitation network coupled between port 42 and dipoles 11, 12, 13, 14. As illustrated, the PPO network includes first and second quadrature couplers 30 and 32, respectively, as shown in FIG. 2 and first and second transmission line sections 34 and 36, respectively, as shown in FIG. 1. Couplers 30 and 32 in this embodiment are wireline quadrature couplers having an external encasement which is soldered or otherwise grounded to conductive layer 18. Each wireline device is a 3 dB coupler having four signal port conductors: input port "a"; output port "b" providing signals of the same phase as input signals; output port "c" providing signals of quadrature phase (i.e., 90 degree phase lag relative to input signals); and port "d" which is resistively terminated (e.g., 50 ohms to ground). While signal input terminology is used for convenience, it will be understood that the couplers operate reciprocally for the present signal reception application.

Considering both the bottom view of FIG. 2 and the top view of FIG. 1, it will be seen that port a conductor 30*a* of wireline coupler 30 is coupled through layers 18/16 and coupled to signal port 42 via line section 34. Port b conductor 30b is coupled through layers 18/16 and coupled to the left arm of first dipole 11, via conductor 11*a*, to provide first dipole excitation of a first phase. Conductor 11*a* and associated shorted stub 11*b* (connected to layer 18 through layer 16) are appropriately dimensioned to provide suitable impedance matching to the dipole using known design techniques. Similarly, port c conductor 30*c* is coupled to the left arm of second dipole 12 via conductor 12*a* to provide second dipole excitation of a quadrature phase (i.e., differing by 90 degrees). Port d conductor 30d passes through layers 18/16 and is terminated by a 50 ohm chip resistor 30*e* mounted on the surface of layer 16 and grounded to layer 18.

Second wireline quadrature coupler 32 is correspondingly coupled to third and fourth dipoles 13 and 14, however, in this case couplings are to the right arms of dipoles 13 and 14 (rather than to the left arms, as above). Thus, port a conductor 32*a* of coupler 32 is coupled to signal port 42 via second transmission line section 36. Port b conductor 32*b* (zero phase) is coupled to the right arm of third dipole 13, via conductor 13*a*, with the phase reversal from opposite-arm excitation (i.e., via right arm v. left arm above) resulting in third dipole excitation of a phase opposite (i.e., differing by 180 degrees) to the first phase excitation of first dipole 11 (e.g., 180 degrees lag). Port c conductor 32*c* (quadrature phase) is coupled to the right arm of fourth dipole 14, via conductor 14*a*, with the quadrature phase and phase reversal from opposite arm excitation resulting in fourth dipole excitation of a phase opposite to the second phase excitation of second dipole 12 (e.g., 180 degrees lag). Port d conductor 32*d* is resistively terminated via chip resistor 32*e*. Shorted stubs 12*b*, 13*b*, and 14*b* as shown are provided for dipoles 12, 13 and 14 as discussed above with reference to stub 11*b*.

During signal reception, this configuration is effective to provide at signal port 42 a signal representative of reception via a 360 degree PPO azimuth antenna pattern. Thus, the PPO network is effective to provide relative signal phasing of zero, −90, −180 and −270 degrees at first, second, third and fourth dipoles 11, 12, 13, 14, respectively, with received signals combined to provide the PPO signal at port 42. The four-dipole element 10 thus operates as a self-contained unit to provide this PPO capability.

For effective GPS operation, the four-dipole element of FIGS. 1–3 is double tuned for operation at the two GPS frequencies of 1,572.42 MHZ and 1,227.6 MHZ. With reference to second dipole 12, double tuning is provided by a tuned circuit utilizing the inductance of a stub comprising gap 12*c* backed up by a rectangular opening in conductive layer 18, in combination with capacitive stub 12*d* connected to layer 18 and overlying a portion of dipole 12. Provision of this tuned circuit enables the dipole to be double tuned using known design techniques, to enable reception at both GPS signal frequencies.

In a presently preferred embodiment, four-dipole element 10 is fabricated as a self-contained unit using printed circuit techniques, with the dipole arms, wireline quadrature couplers and coaxial connector soldered in place. For GPS application, the element 10 has dimensions of approximately three and a quarter inches across and an inch and a quarter in height. The unit is shown slightly enlarged and some dimensions may be distorted for clarity of presentation. The square central opening is dimensioned for placement on a square conductive mast 40 of hollow construction (e.g., a square aluminum pipe shown sectioned in FIG. 3) with electrical connection of ground layer 18 to the mast 40. As will be further described, in a preferred antenna configuration 21 elements identical to element 10 are positioned on a mast in a vertical stack with approximately one-half wavelength element-to-element spacing. In such embodiment, eleven of the elements are directly excited via coaxial cables connected to a signal distribution network and ten of the elements are indirectly excited by radiation coupling. This provides a desired hemispherical antenna pattern particularly effective for reception of GPS signals, as will be described.

Figure 4A:
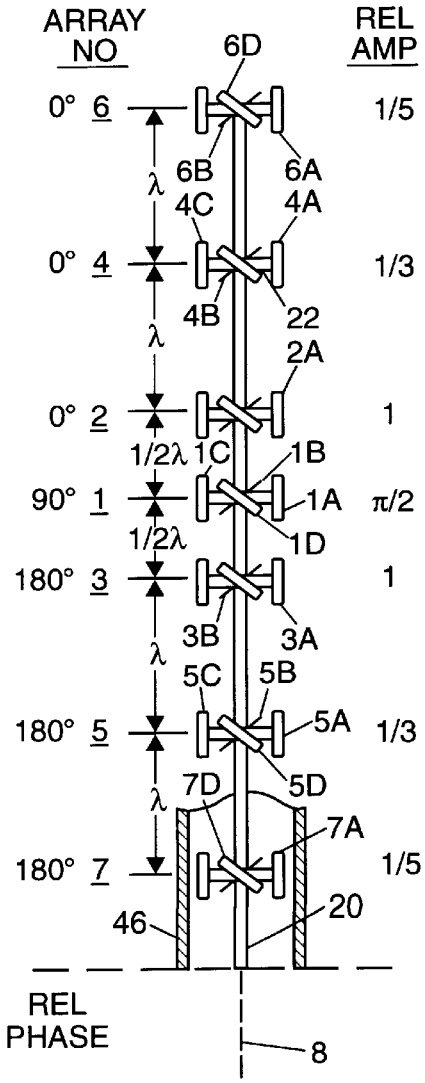
FIG. 4a PRIOR ART
FIGS. 4*a* and 4*b* show a prior antenna system including a stack of seven arrays each having four dipoles.
Figure 5A:
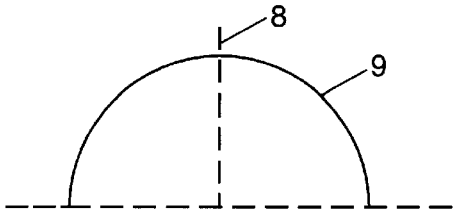
FIG. 5a PRIOR ART
FIGS. 5*a* and 5*b* are conceptual diagrams illustrating hemispherical circularly polarized antenna pattern coverage with a sharp cutoff above horizontal.
Figure 5B:
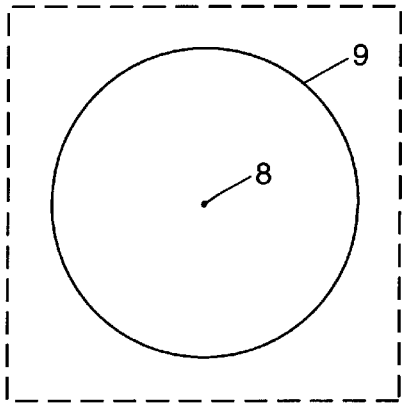
FIG. 5b PRIOR ART

Reference is made to FIG. 4*a* which illustrates a form of antenna system described in U.S. Pat. No. 5,534,882 (the '882 patent) issued to one of the present inventors. Antennas in accordance with the present invention utilize the teaching of the '882 patent in the context of the novel self-contained PPO excited elements which have been described above and antennas (e.g., the FIG. 7 antenna) to be described below. The FIG. 4*a* antenna system is arranged to provide a first circular polarization characteristic (e.g., right circular polarization) horizontally and upward from a plane. This characteristic is figuratively illustrated in FIGS. 5*a* and 5*b* on an ideal basis which, in practice, will be approximated. In FIG. 5*a*, a horizontal plane is represented in side view by a dotted line and a central vertical axis 8 is shown normal to the plane. The circularly polarized antenna pattern is represented by a semicircular solid line 9 showing an antenna radiation pattern which extends equally at all elevations upward to the zenith. The antenna pattern is also shown as having a sharp cutoff at the horizontal plane, which provides for enhanced multipath signal discrimination. FIG. 5*b* shows a plan view of the omnidirective antenna pattern 9 centered about axis 8 on a portion of the horizontal plane, which represents a horizontal stratum for reference purposes, and does not represent any physical antenna element or reflective surface.

Figure 4B:
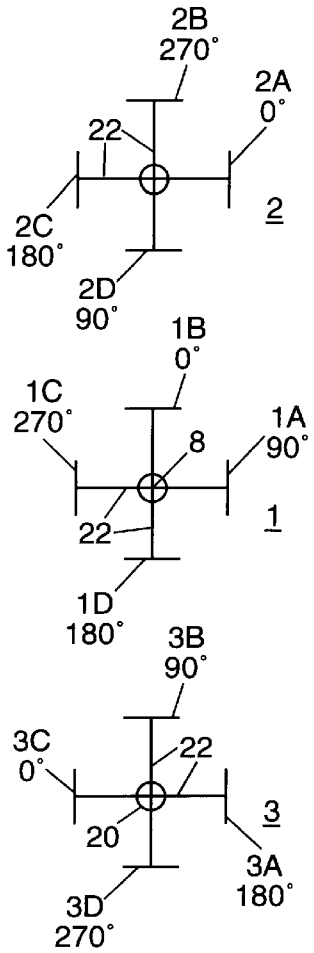
FIG. 4b PRIOR ART

Referring to the FIG. 4*a* antenna system, a mast 20 supporting the antenna system is shown centered on the vertical axis 8 and normal to the horizontal plane. As illustrated, the antenna system includes a plurality of element arrays, shown as dipole arrays 1–7, spaced along mast 20. Considering element array 1, it consists of four dipoles each supported by coupling means illustrated as a base portion (such as shown at 22 with respect to dipole lA) extending from mast 20. As shown for dipole 1D, each dipole is tilted so that its arm portions are at an angle of approximately 45 degrees. In FIG. 4*a* dipole 1D is in the front (permitting its tilted orientation to be seen), side dipoles 1A and 1C are seen in side profile and rear dipole 1B is shown in simplified form as a tilted line (to distinguish it from front dipole 1D). The A, B, C, D dipole labeling is typical for each of the other dipole arrays 2–7. The FIG. 4*a* antenna system looks the same when viewed from the front, the back or either side. Thus, except for the specific dipole labels as shown, FIG. 4*a* may be considered a front, back or side view. FIG. 4*b* shows simplified top views of dipole arrays 1, 2, and 3 of the FIG. 4*a* antenna, illustrating the symmetrical character of the four dipoles of each array. As shown, the four dipoles of each array are equally spaced around the mast 20 at 90 degree angular increments. The boresight of each dipole is thus aligned at an angle differing from the boresight angle of each other dipole in its array by an integral multiple of 90 degrees.

Figure 6:
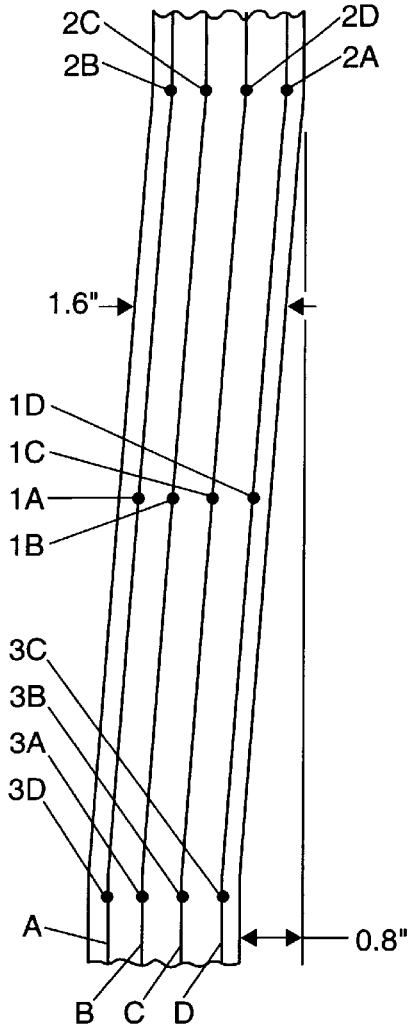
FIG. 6 PRIOR ART
FIG. 6 shows a form of prior arrangement with four transmission lines, each of which feeds one dipole of each of the seven arrays of the FIG. 4*a* antenna system.

FIG. 6 illustrates portions of four transmission lines A, B, C and D which are arranged to serve dipole arrays 1, 2 and 3 of FIG. 4*a*. As shown in FIG. 6 each transmission line is arranged for feeding one predetermined dipole of each of the dipole arrays 1, 2 and 3 (and by extension is also arranged to feed one dipole in each of arrays 4, 5, 6 and 7). Consider transmission line A which, as shown, includes connection points 1A, 2B and 3D labeled to correspond to the individual dipoles in arrays 1, 2 and 3 which are fed from these connection points. With reference to FIG. 4*a* it will be seen that in the antenna system as shown, the lettered dipoles of arrays 2 and 3 are in vertical alignment with the correspondingly lettered dipoles of array 1 (e.g., dipole 2A is directly above, and dipole 3A is directly below, dipole lA in FIG. 4*a*). In FIG. 6 the central portions of lines A, B, C and 1 inclined so that, when the FIG. 6 structure is curved laterally to form a cylinder, the transmission line A (which may be a conductive line on a thin printed circuit substrate) extends both upward and laterally. In this way, if the transmission line length is one-half wavelength at the signal frequency (180 degrees in phase) between points 1A and 2B in FIG. 6, a signal at point 2A (vertically above point 1A in the cylindrical form) will differ in phase by 90 degrees relative to the signal at point 1A, provided lines A, B, C and D are supplied with signals differing in phase by successive 90 degree increments. Thus, if the transmission line sections coupling the connection points were vertical, the half wavelength line lengths between the points would cause 180 degree phase differences between dipoles 1A and 2A, which are in vertical alignment in the FIG. 4*a* antennas system. However, since line A, in the cylindrical form, progresses laterally one-quarter revolution between dipole arrays 1 and 2, the half wavelength line lengths between connection points cause only a 90 degree phase difference between dipole 1A and dipole 2A, which is directly above dipole 1A.

The result, as illustrated in FIG. 4*b*, is that if dipoles 2A, 2D, 2C and 2B of array 2 receive reference phase signals effective to cause the four dipoles to have relative phasing of zero, 90, 180 and 270 degrees as shown, the correspondingly lettered dipoles 1A, 1D, 1C and 1B of array 1 will have relative phasing of 90, 180, 270 and zero degrees. Correspondingly, the dipoles 3A, 3D, 3C and 3B, of array 3 located below array 1, will have relative phasing of 180, 270, zero and 90 degrees. In FIG. 6 it will be seen that above points 2B, 2C, 2D and 2A, and below points 3D, 3A, 3B and 3C, the transmission lines 30, 32, 34 and 36 proceed vertically, without any lateral or angular progression. As a result, signals at points 4B, 4C, 4D and 4A (not shown in FIG. 6) will have the same respective phasing as the signals at points 2B, 2C, 2D and 2A, provided that the line lengths separating array 4 from array 2 and array 6 from array 4 are each equal to one full wavelength at the signal frequency (360 degrees in phase). Under similar conditions the signal phasing at arrays 5 and 7 will be the same as for array 3. In overview, it will thus be seen that each array provides a PPO antenna pattern, however, the signal phasing at arrays 2 and 3 have respectively been rotated forward (lead) and backward (lag) by 90 degrees relative to the array 1 signal phasing. Other portions of a signal distribution arrangement for providing signals of appropriate relative phase to the transmission lines A, B, C and D are described in the '882 patent.

As a result of the excitation array 1, with four 45 degree angled dipoles positioned symmetrically around mast 20 and supplied with signals as described, will be effective to produce a right circular polarized radiation pattern around axis 12 which has a 360 degree PPO characteristics, as indicated by the relative phasing shown for dipoles 1A, 1B, 1C and 1D in FIG. 4*b*. Similarly, signals are coupled to the dipoles of the second dipole array of relative phase effective to produce a second PPO radiation pattern around axis 12 similar to the first such pattern, but which is shifted in azimuth by an angle of 90 degrees (i.e., 90 degrees phase lag) and to dipoles 3A, 3B, 3C and 3D to produce a similar 360 degree third PPO radiation pattern also shifted in azimuth relative to the first such pattern (i.e., 90 degrees phase lead). Additional arrays (e.g., some or all of arrays 4, 5, 6 and 7, plus additional similar arrays as suitable in particular applications) may be included and excited to provide appropriately aligned 360 degree circularly polarized PPO radiation patterns. Additional details as to the feed configuration, construction and operation of the FIG. 4*a* antenna system are provided in the '882 patent.

There are thus disclosed in the '882 patent antennas providing a circularly polarized hemispherical-type antenna pattern with PPO excitation as represented in FIGS. 5*a* and 5*b*. The patent utilizes what are therein termed element arrays, each including four dipoles, with the element arrays positioned along a mast in a vertical configuration. While each element array of the patent has similarities to the four-dipole element described above pursuant to the present invention (e.g., use of four diagonal dipoles positioned around an axis) excitation is implemented in a different manner. For each element array of the patent four signal feeds are needed, so that as described the four dipoles 1A, 1B, 1C, 1D of element array 1 of FIGS. 4*a* and 4*b* are respectively fed from points 1A, 1B, 1C, 1D on the four separate transmission lines of FIG. 6. In contrast, for the present invention each four-dipole element of FIG. 1 is fed via a single signal port (e.g., port 42 in FIG. 1). The four-dipole element of FIG. 1 is thus termed a self-contained unit. Rather than requiring four signal feeds, each differing in phase by 90 degrees, to provide a desired PPO antenna pattern, self-contained element 10 itself produces the relative signal phasing for the four dipoles as necessary to provide the PPO antenna pattern.

The result is that, while an antenna pursuant to the present invention (as in FIG. 7, to be described) uses the invention of the '882 patent, a four-dipole element as in FIGS. 1–3 is a novel self-contained antenna element and may readily be assembled into new and improved forms of GPS antennas.

Figure 7:
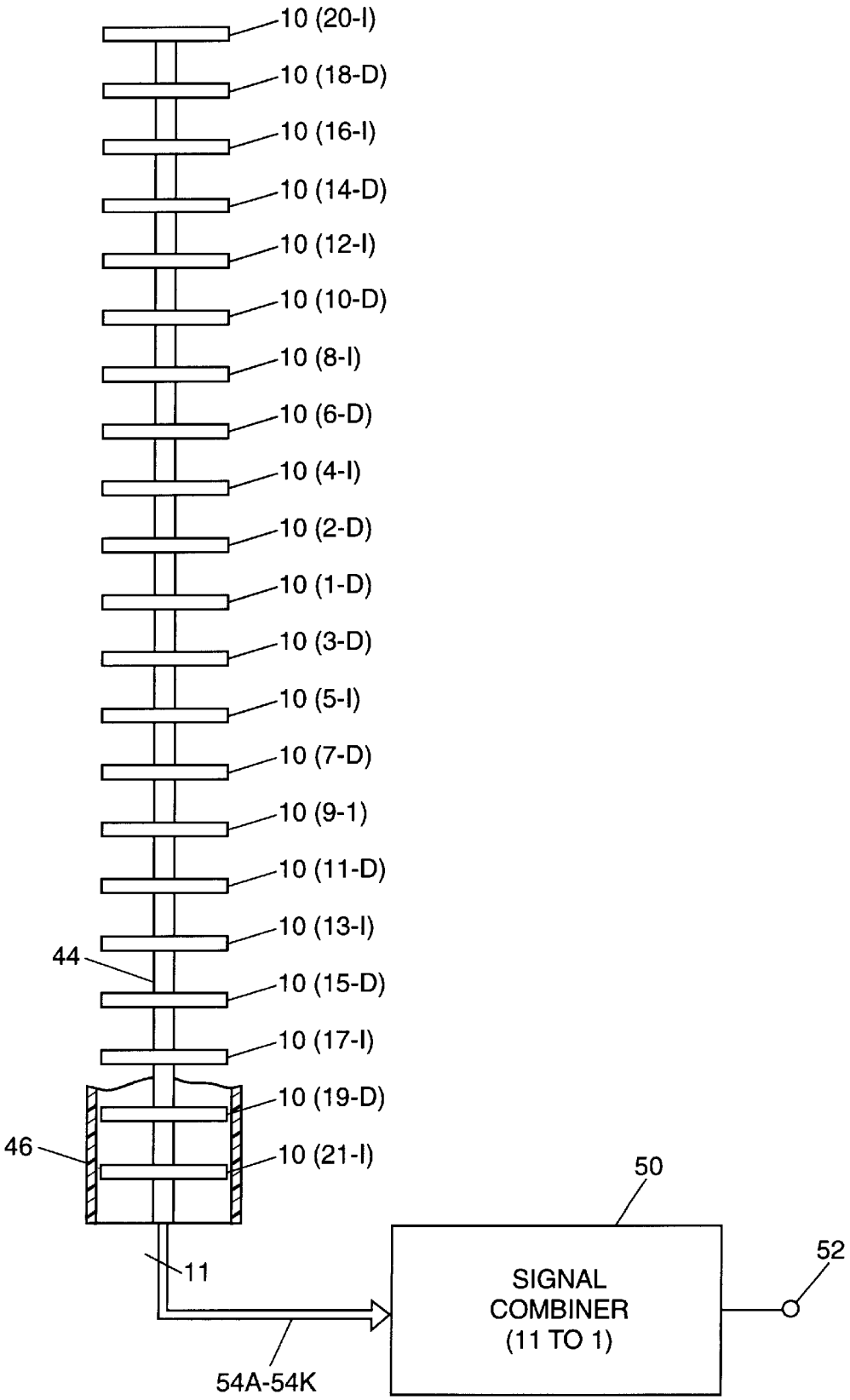
FIG. 7 illustrates a GPS antenna in accordance with the present invention, which includes a stack of 21 four-dipole elements of the type shown in FIGS. 1–3, eleven of which are directly excited with the remaining elements indirectly excited.

As illustrated in FIG. 7, one embodiment of a GPS antenna pursuant to the invention includes a four-dipole first element 10(1-D) and a plurality of additional identical elements, including ten upper elements positioned above first element 10(1-D)and ten lower elements positioned below first element 10(1-D). The elements are supported along rectangular mast 44 with vertical element-to-element spacings of approximately one-half wavelength at a frequency in the operating range. In this embodiment, each of the elements of the FIG. 7 antenna is identical to element 10 of FIGS. 1–3. In FIG. 7, each element is identified with the reference numeral 10, indicating correspondence to element 10 of FIGS. 1–3, and a parenthetical indicating the individual element number and whether it is directly excited by connection to signal combiner 50 (e.g., element 10(4-D) is directly excited) or indirectly excited and not connected to signal combiner 50 (e.g., element 10(6-I) is indirectly excited). As shown, the ten upper elements 10(2-D), 10(4-I), 10(6-D), 10(8-I), 10(10-D), 10(12-I), 10(14-D), 10(16-I), 10(18-D) and 10(20-I) positioned above first element 10(1-D) all have individual element numbers which are even and indirectly excited elements are in alternating positions with directly excited elements. Also, the ten lower elements 10(3-D), 10(5-I), 10(7-D), 10(9-I), 10(11-D), 10(13-I), 10(15-D), 10(17-I), 10(19-D), and 10(21-I) positioned below first element 10(1-D) all have individual element numbers which are odd and indirectly excited elements are in alternating positions with directly excited elements.

Although elements are described in terms of being directly or indirectly "excited", it will be understood the FIG. 7 antenna is intended for reception of GPS satellite signals. As represented in FIG. 7, received signals are provided to signal combiner 50 by eleven signal paths 54A–54K (e.g., coaxial cables). Each of cables 54A–54K, which are typically of equal length, connects to the signal port (e.g., connector 42 of the FIG. 1 element) of one of the eleven directly excited elements. In this embodiment there are no cable connections to the ten indirectly excited elements, the signal ports of which may be suitably terminated. To provide the desired antenna pattern as discussed above with reference to the FIG. 4*a* antenna system, signal combiner 50 is arranged to: provide reference phase signals to the first element (element 10(1-D) the center element); provide to each of the directly excited upper elements signals which lag that reference phase by 90 degrees; and provide to each of the directly excited lower elements signals which lead by 90 degrees. As an alternative, it will be apparent that the desired PPO excitations which lead and lag by 90 degree phase differentials can be provided by permanently rotating selected elements by 90 degrees in azimuth and coupling of reference or same phase signals to each of the eleven directly excited elements. Thus, for this alternative Hiconfiguration all of the upper elements above first element 10(1-D) can be placed on the square mast 44 in a physical alignment rotated forward (clockwise, looking down from above) one quarter turn or 90 degrees, relative to the first element. Similarly, all of the lower elements can be placed on the square mast 44 in a physical alignment rotated backward one quarter turn or 90 degrees, relative to the first element 10(1-D).

Referring again to FIG. 4*a*, it will be seen that "REL AMP" values are shown to the right of arrays 1–7. These values represent the relative amplitude (e.g., voltage) of signals provided to dipoles of the respective arrays in order to achieve the desired antenna pattern discussed with reference to FIGS. 5*a* and 5*b*. If only seven of the four-dipole elements of FIG. 7 were directly excited, the same relative amplitude of signals could be employed for the FIG. 7 antenna. However, with inclusion of eleven directly excited four-dipole elements in the FIG. 7 antenna, the following relative voltage amplitudes of excitation are employed for this configuration for the directly excited elements:

| | |
|---|---|
| top upper element 10(18-D) | 0.05553 |
| next to top upper element 10(14-D) | 0.06228 |
| middle upper element 10(10-D) | 0.1055 |
| next to bottom upper element 10(6-D) | 0.1985 |
| bottom upper element 10(2-D) | 0.6320 |
| first element 10(1-D) | 1.0 |
| top lower element 10(3-D) | 0.6320 |
| next to top lower element 10(7-D) | 0.1985 |
| middle lower element 10(11-D) | 0.1055 |
| next to bottom lower element 10(15-D) | 0.06228 |
| bottom lower element 10(19-D) | 0.05553 |

While specific values are given above, particular implementations of this embodiment may use values which are nominally those stated above. "Nominally" is defined as being within plus or minus twenty percent of a stated value.

In operation of the FIG. 7 antenna, signal combiner 50 is arranged to combine signals coupled via the eleven lines 54A–54K in appropriate relative phase and amplitude to provide at antenna output port 52 a composite signal representing an antenna pattern having characteristics as described with reference to FIGS. 5*a* and 5*b*. A portion of a cylindrical radome 46 is shown in FIG. 7. Suitable additional features and fixtures, including arrangements to mount the antenna in an upright position and house components such as signal combiner 50, can be implemented by skilled persons, as appropriate.

Figure 8:
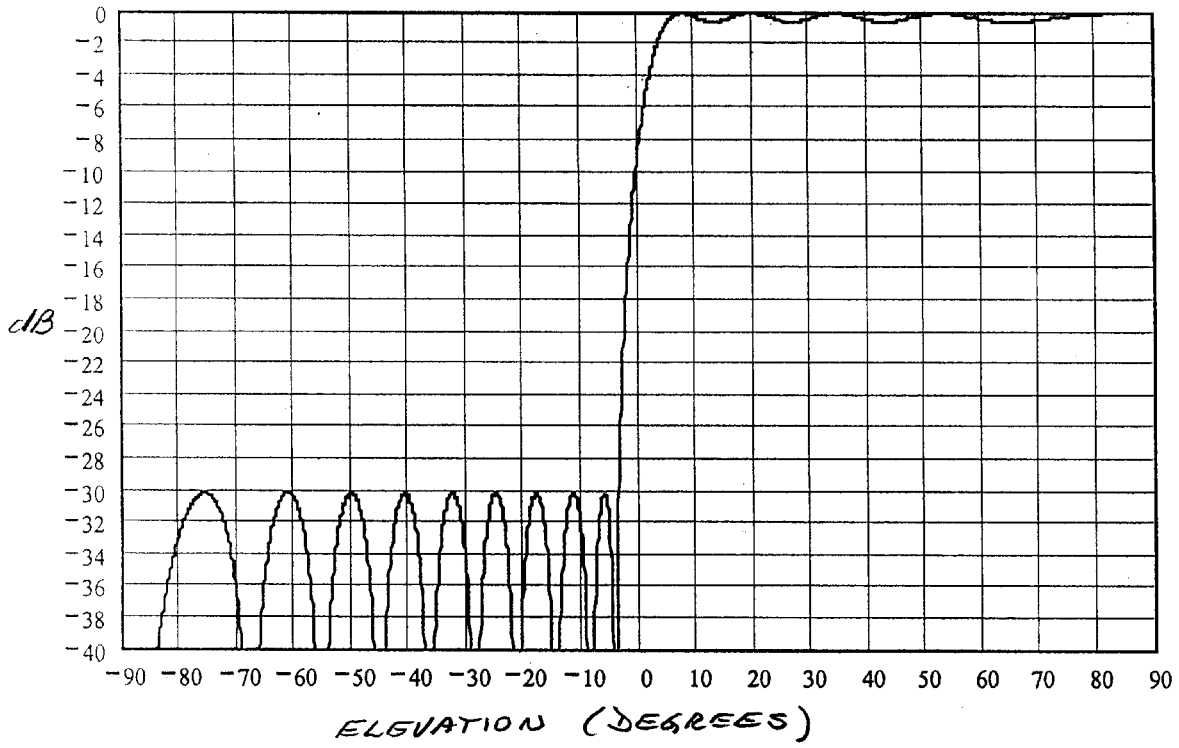
FIG. 8 is a computer generated antenna pattern for the FIG. 7 antenna illustrating substantially uniform gain from horizon (0°) to zenith (90°) with sharp pattern cutoff below the horizon.

FIG. 8 is a computer generated vertical plane antenna pattern for a FIG. 7 type antenna, showing gain v. elevation angle data for right circular polarization. As shown, gain is relatively uniform from slightly above the horizon to the zenith (8 to 90 degrees elevation) with a sharp cutoff at the horizon (e.g., the horizontal plane shown dotted in FIGS. 5*a* and 5*b*). Below the horizon all sidelobes are indicated to be 30 dB down, below the horizon to the nadir (−8 to −90 degrees elevation). Thus, in addition to providing an antenna pattern omnidirectional in azimuth, full upper hemispherical circularly polarized coverage is provided. Also, the sharp cutoff below horizontal is particularly effective in limiting reception of signals upwardly reflected from the ground.

The use of four-dipole elements pursuant to the invention (e.g., element 10 of FIG. 1) has been described in the context of a high performance antenna suitable for providing very low phase error signal reception suitable for meeting performance specifications required for Differential GPS aircraft landing applications. With an understanding of the invention a variety of different forms of antennas can be provided, including antennas employing a smaller number of four-dipole elements for less critical applications. Thus, while there have been described the currently preferred embodiments of the invention, those skilled in the art will recognize that other and further modifications may be made without departing from the invention and it is intended to claim all modifications and variations as fall within the scope of the invention.

What is claimed is:

1. A four-dipole element, double tuned for reception at two GPS frequencies and including a progressive-phase-omnidirectional excitation network, comprising:

first, second, third and fourth dipoles successively spaced around a vertical axis and each having two opposed arms;

a signal port; and a progressive-phase-omnidirectional (PPO) excitation network, coupled between the signal port and the four dipoles, including:

(a) a first quadrature coupler coupled between the first and second dipoles to provide first dipole excitation of a first phase and to provide second dipole excitation of a quadrature phase, (b) a second quadrature coupler coupled between the third and fourth dipoles to provide third dipole excitation of a phase differing by 180 degrees from said first phase and to provide fourth dipole excitation of a quadrature phase differing by 180 degrees from the second dipole excitation, and (c) first and second transmission line sections respectively coupled between the signal port and the first and second quadrature couplers; and four resonant circuits, one coupled to each dipole to provide double tuning for signal reception at two GPS frequencies, each said resonant circuit including the combination of an inductive stub, comprising a gap between the two arms of a dipole, and a capacitive stub, comprising a line section overlying a dipole portion.

2. A four-dipole element as in claim 1, constructed as a self-contained unit configured to provide, at the signal port, a signal representative of reception via a 360 degree PPO azimuth antenna pattern.

3. A four-dipole element as in claim 1, wherein each dipole has a left arm and a right arm, when viewed from the vertical axis, and wherein:

the first quadrature coupler has a port coupled to the left arm of the first dipole and a quadrature port coupled to the left arm of the second dipole, and the second quadrature coupler has a port coupled to the right arm of the third dipole and a quadrature port coupled to the right arm of the fourth dipole.

4. A four-dipole element as in claim 1, wherein the opposed arms of each dipole are positioned diagonally relative to horizontal.

5. A GPS antenna, with progressive-phase excitation, comprising:

a four-dipole first element including a signal port and first, second, third and fourth dipoles successively spaced around a vertical axis and each having two diagonally aligned opposed arms, said first element incorporating a progressive-phase-omnidirectional (PPO) excitation network including:

(a) a first quadrature coupler coupled to the signal port and coupled between the first and second dipoles to provide first dipole excitation of a first phase and to provide second dipole excitation of a quadrature phase, and (b) a second quadrature coupler coupled to the signal port and coupled between the third and fourth dipoles to provide third dipole excitation of a phase differing by 180 degrees from said first phase and to provide fourth dipole excitation of a quadrature phase differing by 180 degrees from the second dipole excitation;

a plurality of four-dipole additional elements each having a PPO excitation network with first and second quadrature couplers as described at (a) and (b) above, said plurality including upper elements positioned above and lower elements positioned below the first element along said vertical axis;

a signal distribution network coupled between an antenna output port and the signal ports of the first element and a plurality of the additional elements; and a vertically-extending structure to support the first and additional elements;

said upper elements including upper elements connected to and directly fed by the signal distribution network and at least one upper element not connected to and directly fed by the signal distribution network, and said lower elements including lower elements connected to and directly fed by the signal distribution network and at least one lower element not connected to and directly fed by the signal distribution network.

6. A GPS antenna as in claim 5, wherein the PPO excitation of said directly fed upper elements lags the PPO excitation of the first element by a 90 degree phase differential, and the PPO excitation of said directly fed lower elements leads the PPO excitation of the first element by a 90 degree phase differential.

7. A GPS antenna as in claim 5, wherein:

said upper elements include five upper elements connected to and directly fed by the signal distribution network to provide PPO excitation lagging such excitation of the first element by a 90 degree phase differential and said lower elements include five lower elements connected to and directly fed by the signal distribution network to provide PPO excitation leading such excitation of the first element by a 90 degree phase differential.

8. A GPS antenna as in claim 5, wherein in the first element and in each additional four-dipole element, each dipole has a left arm and a right arm, when viewed from the vertical axis, and wherein:

the first quadrature coupler has a port coupled to the left arm of the first dipole and a quadrature port coupled to the left arm of the second dipole, and the second quadrature coupler has a port coupled to the right arm of the third dipole and a quadrature port coupled to the right arm of the fourth dipole.

9. A GPS antenna as in claim 5, wherein in the first element and in each additional four-dipole element, the boresight of each dipole is aligned at an angle differing from the boresight angle of each other dipole of the element by an integral multiple of 90 degrees and the excitation phase of each dipole also differs by an integral multiple of 90 degrees.

10. A GPS antenna as in claim 5, wherein each dipole includes two opposed arms positioned diagonally relative to horizontal, with each arm swept back toward said axis and positioned diagonally relative to a radial line from the axis to a midpoint between the two opposed arms.

11. A GPS antenna, with progressive-phase-omnidirectional excitation, comprising:

a four-dipole first element including a signal port and first, second, third and fourth dipoles successively spaced around a vertical axis and each having two opposed arms, said first element incorporating a progressive-phase-omnidirectional (PPO) excitation network including:

(a) a first quadrature coupler coupled to the signal port and coupled between the first and second dipoles to provide first dipole excitation of a first phase and to provide second dipole excitation of a quadrature phase, and (b) a second quadrature coupler coupled to the signal port and coupled between the third and fourth dipoles to provide third dipole excitation of a phase differing by 180 degrees from said first phase and to provide fourth dipole excitation of a quadrature phase differing by 180 degrees from the second dipole excitation, and (c) four resonant circuits, one coupled to each dipole to provide double tuning for signal reception at two GPS frequencies, each said resonant circuit including the combination of an inductive stub, comprising a gap between the two arms of a dipole, and a capacitive stub, comprising a line section overlying a dipole portion; and a plurality of four-dipole additional elements each having a PPO excitation network with first and second quadrature couplers and four resonant circuits as described at (a), (b) and (c) above, said plurality including upper elements positioned above and lower elements positioned below the first element along said vertical axis.

12. A GPS antenna as in claim 11, wherein each dipole includes two arms which are positioned diagonally relative to horizontal, with each arm swept back toward said axis and positioned diagonally relative to a radial line from the axis to a midpoint between the two opposed arms.

13. A GPS antenna, with progressive-phase excitation, comprising:

a four-dipole first element including a signal port and first, second, third and fourth dipoles successively spaced around a vertical axis and each having two diagonally aligned opposed arms, said first element incorporating a progressive-phase-omnidirectional (PPO) excitation network including:

(a) a first quadrature coupler coupled to the signal port and coupled between the first and second dipoles to provide first dipole excitation of a first phase and to provide second dipole excitation of a quadrature phase, and (b) a second quadrature coupler coupled to the signal port and coupled between the third and fourth dipoles to provide third dipole excitation of a phase differing by 180 degrees from said first phase and to provide fourth dipole excitation of a quadrature phase differing by 180 degrees from the second dipole excitation;

a plurality of four-dipole additional elements each having a PPO excitation network with first and second quadrature couplers as described at (a) and (b) above, said plurality including five upper elements positioned above and five lower elements positioned below the first element along said vertical axis;

a vertically-extending structure to support the elements; and a signal distribution network coupled between an antenna output port and the signal ports of the first element and said five upper and five lower elements, to provide PPO excitation of the five upper elements lagging excitation of the first element by a 90 degree phase differential and PPO excitation of the five lower elements leading excitation of the first element by a 90 degree phase differential;

the signal distribution network configured to provide signals of nominally the following relative voltage amplitudes to the respective signal ports of said five upper and five lower elements:

| | |
|---|---|
| top upper element | 0.05553 |
| next to top upper element | 0.06228 |
| middle upper element | 0.1055 |
| next to bottom upper element | 0.1985 |
| bottom upper element | 0.6320 |
| first element | 1.0 |
| top lower element | 0.6320 |
| next to top lower element | 0.1985 |
| middle lower element | 0.1055 |
| next to bottom lower element | 0.06228 |
| bottom lower element | 0.05553. |

14. A GPS antenna as in claim 13, wherein:

said upper elements additionally include at least one upper element not connected to and directly fed by the signal distribution network, and said lower elements additionally include at least one lower element not connected to and directly fed by the signal distribution network.

15. A GPS antenna as in claim 13, wherein each dipole includes two arms which are positioned diagonally relative to horizontal, with each arm swept back toward said axis and positioned diagonally relative to a radial line from the axis to a midpoint between the two opposed arms.

* * * * *